US006509727B2

(12) United States Patent
Fahrenbruch

(10) Patent No.: US 6,509,727 B2
(45) Date of Patent: Jan. 21, 2003

(54) LINEAR REGULATOR ENHANCEMENT TECHNIQUE

(75) Inventor: Shawn A. Fahrenbruch, Tustin, CA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/957,576

(22) Filed: Sep. 19, 2001

(65) Prior Publication Data

US 2002/0093316 A1 Jul. 18, 2002

Related U.S. Application Data

(60) Provisional application No. 60/252,960, filed on Nov. 24, 2000.

(51) Int. Cl.[7] ..... G05F 3/16

(52) U.S. Cl. ..... 323/316; 327/541; 327/542

(58) Field of Search ..... 327/539, 540, 327/541, 542; 323/316, 280

(56) References Cited

U.S. PATENT DOCUMENTS

| | | | | |
|---|---|---|---|---|
| 5,315,231 A | * | 5/1994 | Linder et al. | 323/313 |
| 5,867,015 A | * | 2/1999 | Corsi et al. | 323/316 |
| 5,929,696 A | * | 7/1999 | Lim et al. | 323/316 |
| 5,939,870 A | | 8/1999 | Nguyen et al. | |

* cited by examiner

*Primary Examiner*—Shawn Riley
(74) *Attorney, Agent, or Firm*—Bret J. Petersen; W. James Brady; Frederick J. Telecky, Jr.

(57) ABSTRACT

A linear regulator circuit to regulate an output voltage includes a first current path to conduct a first current, a feedback path to provide feedback to maintain the output voltage at a constant voltage, and a transistor positioned in the first current path to provide the output voltage.

6 Claims, 2 Drawing Sheets

LINEAR REGULATOR ENHANCEMENT TECHNIQUE

This application claims priority under 35 USC §119(e) (1) of provisional application Ser. No. 60/252,960, filed Nov. 24, 2000.

FIELD OF THE INVENTION

The present invention relates to a voltage regulator such as a linear voltage regulator and the associated circuitry.

BACKGROUND OF THE INVENTION

A DC-to-DC voltage regulators typically are used to convert a DC input voltage to either a high or a low DC output voltage. One type of voltage regulator, called a linear regulator, is often chosen due to its simple design.

Referring to FIG. 1, a linear regulator may use a transistor 106 to conduct current from an input voltage source 116 (providing a voltage called unfiltered supply voltage) to a load 102 that is coupled to an output terminal 120 of the regulator 100. To regulate an output voltage (called $V_{OUT}$), the regulator 100 may include an error amplifier 114 that amplifies the difference between a reference voltage obtained from reference voltage source 116 and a signal (called $V_F$) that is proportional to the output voltage. Due to negative feedback, an error voltage that is formed by the amplifier 114 functions to control the transistor 106 in such a manner as to keep the $V_{OUT}$ voltage within prescribed limits. The reference voltage $V_{REF}$ may be provided by, for example, a low power voltage reference circuit 116. Other features of regulator 100 may include an RC filter formed by resistor 110 and capacitor 112. This low-pass filter filters high-frequency noise through capacitor 112.

When the regulator 100 powers up, the voltages and currents of regulator 100 fluctuate until the voltages and currents reach steady state, or quiescent, bias levels. Unfortunately, these fluctuations may produce power surges that cause the $V_{IN}$ and $V_{OUT}$ voltages to vary outside of specified tolerances. For example, the $V_{IN}$ and $V_{OUT}$ voltages may be supplied by voltage rails of a computer system power supply and may not be able to vary beyond a predetermined percentage (for example, five percent) of the predetermined voltage level, which may be five volts.

To minimize the effects that regulator 100 imposes on the input voltage source during power-up, a limitation may be placed on the slew rate of the regulator 100. In particular, the slew rate is the maximum rate at which the regulator 100 can change the $V_{OUT}$ voltage. By limiting the slew rate, voltage and current fluctuations in the $V_{OUT}$ voltage are dampened when the regulator 100 powers up. Unfortunately, designs that limit the slew rate for purposes of regulating the power-up state of the regulator 100 may cause the regulator 100 to respond poorly to transient load conditions during normal operation of the regulator 100. Thus, there is a continuing need for a regulator having a sufficient slew rate to accommodate the state of the regulator. Additionally, it is necessary to improve the existing power supply rejection ratio (PSRR) without adding undue complexity to the design of the linear regulator.

As illustrated in FIG. 1, the unfiltered supply voltage is typically at 3.3 volts, and the load circuit 102 requires voltages ranging from 1.1 volts to 1.8 volts. There are many topologies for linear regulators. In FIG. 1, the buffer feedback circuit comes directly from the operational amplifier. Feedback might be taken from the source or emitter of a MOS transistor or a bipolar junction transistor (BJT), as the case may be. The reference circuit 116 could employ an auto-calibration loop; however, the reference voltage might be supplied from a band gap voltage reference circuit. There are many mechanisms that can cause degradation in the PSRR. One of these is the output impedance of transistor 106. As the unfiltered supply voltage modulates, part of that modulation will transfer from the drain of transistor 106 to the source of the transistor 106. Additionally, higher frequencies result in increased PSRR. This results from the capacitive parasitic paths found in transistor 106. Thus, with high-frequency modulation from the unfiltered supply voltage, capacitive coupling can occur from the drain-gate capacitance of transistor 106, and this high-frequency modulation can be coupled to the load through the gate-source capacitance of transistor 106.

SUMMARY OF THE INVENTION

The present invention significantly improves the PSRR. More particularly, the present invention improves the PSRR due to voltage modulation that is transferred from the drain of a transistor to the source of the transistor where that transistor is used to connect the voltage supply to the load. Additionally, the present invention improves PSRR due to high-frequency modulation of the unfiltered supply voltage that is coupled through the drain-to-gate capacitance of the transistor used to couple the voltage to the load. This high-frequency modulation is then coupled to the load.

DETAILED DESCRIPTION OF THE PRESENT INVENTION

Figure 1:
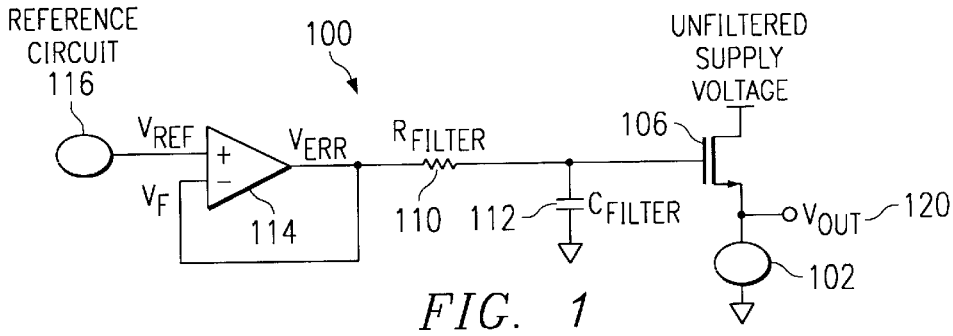
FIG. 1 illustrates a linear regulator.
Figure 2:
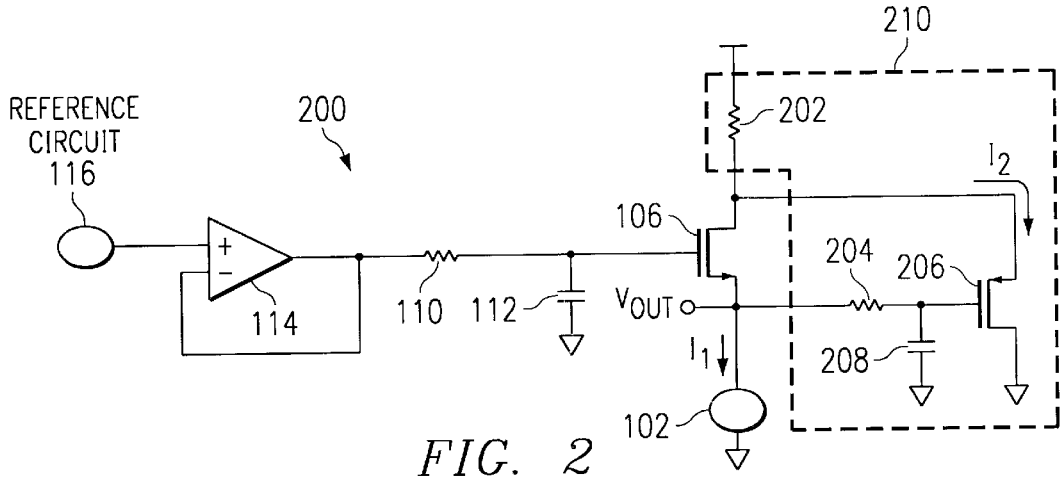
FIG. 2 illustrates a linear regulator of the present invention.

The circuit 210, as illustrated in FIG. 2, of the present invention is transferable to any linear regulator where the load operates at a voltage lower than the raw supply voltage by some level or margin that allows for the voltage drop of the pass device, such as transistor 106 in the present embodiment. The circuit 210 includes resistor 202, resistor 204, capacitor 208, and transistor 206. The present invention adds an additional current path between the supply voltage and ground. This is illustrated by the current path of current $I_2$. The resistor 202 is connected between the supply voltage and the drain of NFET 106. Additionally, NFET 206 at its source is connected to one end of resistor 202 and to the drain of NFET 106. The source of NFET 206 is connected to ground. The gate of NFET 206 is connected to resistor 204 and to capacitor 208. The other end of resistor 204 is connected to the source of transistor 106 as well as the output terminal. The gate of transistor 206 is connected to a relatively fixed voltage potential. Alternatively, the gate of transistor 206 could be connected to ground. As the drain of transistor 106 raises in voltage, the current through transistor 206 is increased. The present invention includes two current sources. The first current path is through the drain-to-source of transistor 106 while the second current path is through the source-to-drain of transistor 206. The current through the first current path is represented by $I_1$, and the current through the second current path is $I_2$. Thus, as the drain of transistor 106 increases in voltage, the current $I_2$ in the second current path through transistor 206 increases. Since the current $I_2$ of the second current path through transistor 206 has increased, the voltage across resistor 202 increases and, consequently, the voltage at the drain of transistor 106 reduces. This reduces the current. The connection from the source of transistor 106 to the gate of transistor 206 introduces a high-frequency path which, unfiltered, would result in unstable operation of transistor 206. Consequently, a low-pass filter of resistor 204 and capacitor 208 has been added between the source of transistor 106 and the gate of transistor 206, more particularly, a resistor 204 and capacitor 208. As a consequence, any high-frequency modulating at the source of NFET 106 is shunted through resistor 204 and through capacitor 208 to ground.

Equation 1 is a derivation of the small signal model of FIG. 2 in order to study PSRR.

$$Vout = \frac{(Ro2 * Rload) * Vsup\ ply + (Ro1 * Rload * (Ro2 + Rs + gm2 * Rs * Ro2)) * Vgate1}{\left\{Ro1 * Rload * (Ro2 + Rs + gm2 * Rs * Ro2) * \left\{gm1 + \frac{1}{Rload} + \frac{1}{Ro1}\right\}\right\} + Ro2 * Rs - gm2 * Rs * Rload * Ro2}$$

For purposes of this analysis, the gate of transistor 106 is assumed to be coupled to an ideal voltage source. This assumption decouples the nonideal effects of the operational amplifier.

Table 1 illustrates the values used to determine $V_{OUT}$, the voltage of the load.

| | | |
|---|---|---|
| Gm1 | = | 0.0158 |
| Ro1 | = | 10500.0 |
| Gm2 | = | 0.0111 |
| Ro2 | = | 7000.0 |
| Rload | = | 1500.0 |
| Rs | = | 250.0 |

$V_{OUT}$ is the voltage of the load; Ro1 is the output impedance of transistor 106 with the transistor 106 having a transconductance equal to Gm1. Ro2 is the output impedance of transistor 206 with the transconductance of transistor 206 being Gm2. Rload is an approximation of the load, and Vsup ply is the unregulated supply voltage. Substituting these values into the equation, it can be seen that the voltage pertubations as seen by the load should be down by a factor of 0.00151, which is approximately −56 dB PSRR at DC.

Equation 2 illustrates $V_{OUT}$ using the same values for Rload, Gm1 and Ro1.

$$Vout = \frac{Rload * Vsup\ ply}{gm1 * Rload * Ro1 + Ro1 + Rload}$$

From this equation, the value of PSRR is 0.00575 (−44.8 dB). Therefore, one can see a significant improvement on the order of approximately 11 dB.

Figure 3:
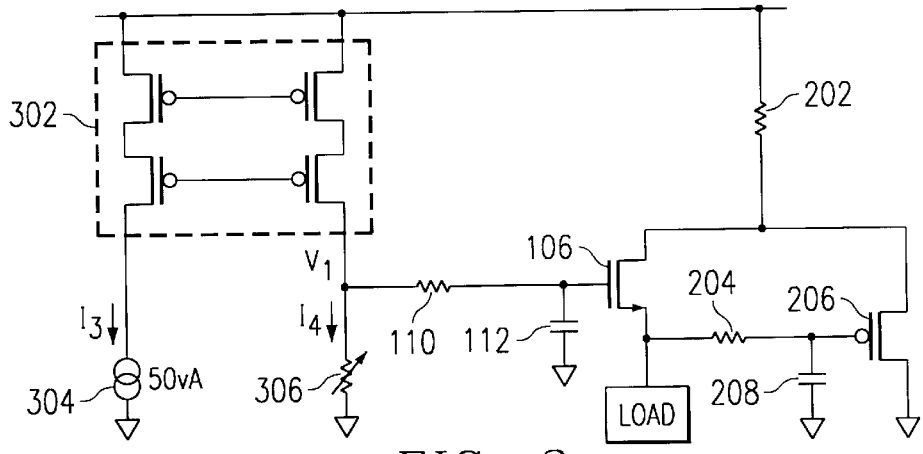
FIG. 3 illustrates another embodiment of a linear regulator in accordance with the invention.

FIG. 3 illustrates results of the present invention. Here, the resistance of resistor 202 is set at 250 ohms. The value of resistor 204 is 100 kilo ohms. Capacitor 208 is 1 PF. Resistor 110 is set at 100 kilo ohms with capacitor 112 set at 10 PF. Additionally, the linear regulator includes two additional current paths, namely a third current path, illustrated by $I_3$, and a fourth current path, illulstrated by $I_4$. The third current path has current $I_3$ flowing through it while the fourth current path has current $I_4$ flowing through it. A current generator 304 provides a constant current, for example 50 microamps, through the third current path. The current mirror 302 mirrors this current through to the fourth current path. Thus, $I_4$ is 50 microamps. The resistor 306 is set at 20K.

Figure 4:
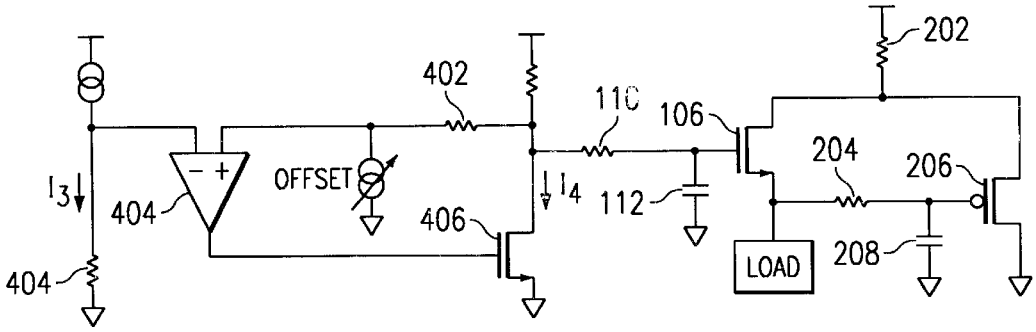
FIG. 4 illustrates yet another linear regulator in accordance with the present invention.

Turning now to FIG. 4, this figure illustrates a similar circuit, again with a third current path and a fourth current path, again represented by current $I_3$ and $I_4$, respectively. A comparator 404 compares the voltage between the third and fourth current paths, and an output from the comparator 404 is connected to the gate of transistor 406.

Figure 5:
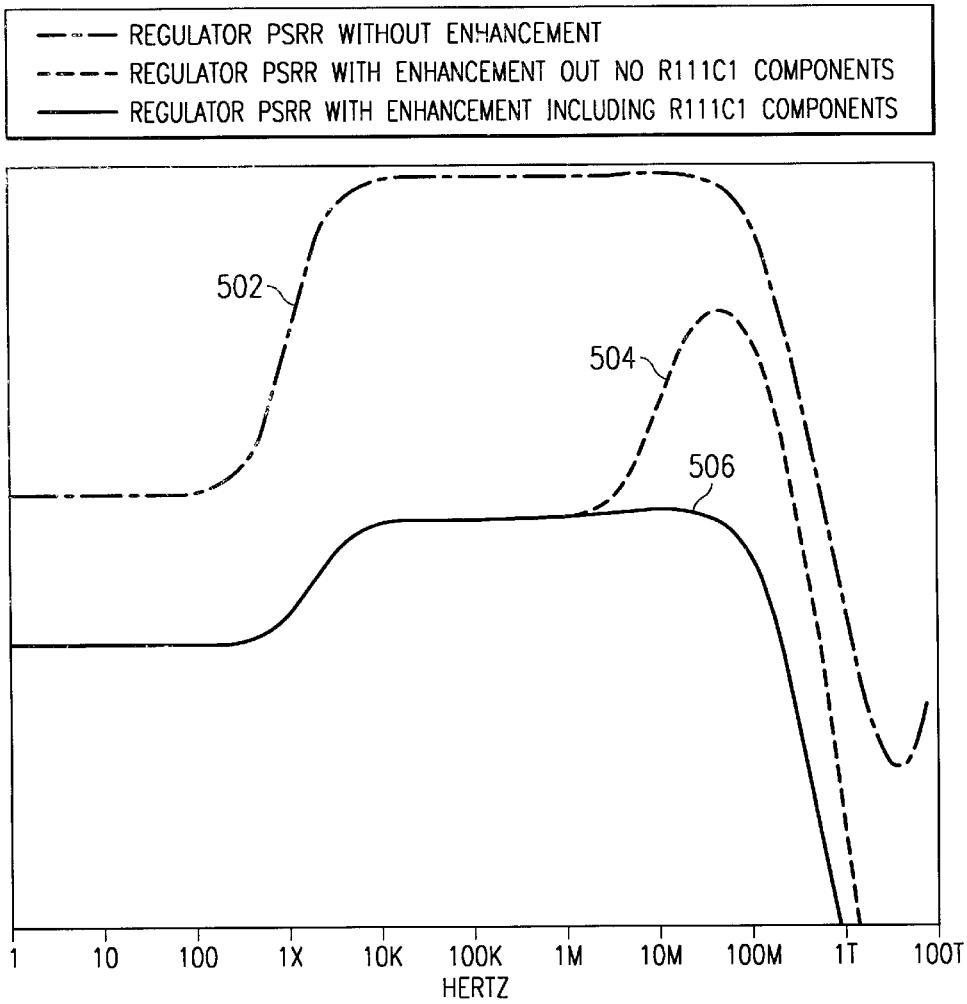
FIG. 5 illustrates simulation results.

FIG. 5 illustrates the results curve 502 illustrates the PSRR without the advantages of the circuits of the present invention. Curve 504 illustrates an approximately 12 dB gain in the center of the curve with respect to curve 502. However, this circuit of curve 504 fails to include resistor 204 and resistor 208 and has a direct connection between the source of transistor 106 and the gate of transistor 206. Thus, at higher frequencies, the response degrades as a result of the modulating noise affecting the operation of transistor 206. Curve 506 illustrates the effect of the circuit of the present invention with resistor 204 and capacitor 208 employed. As expected, the degradation of the curve at higher frequencies does not occur since the high-frequency modulation of the voltage at the gate of transistor 206 does not occur. A bipolar transistor could be substituted for transistor 206.

What is claimed is:

1. A linear regulator circuit to regulate an output voltage, comprising:

a first current path to conduct a first current comprising a first transistor connected to a source voltage through a first resistor and to the output voltage;

a second current path to provide feedback to maintain said output voltage at a constant voltage, wherein said second current path includes a second transistor with a first terminal connected to the first transistor and the first resistor, a second terminal connected to a reference voltage, and a gate/base connected to the output voltage through a second resistor.

2. A linear regulator circuit as in claim 1, wherein said first transistor is a FET.

3. A linear regulator circuit as in claim 1, wherein said first transistor is a NFET.

4. A linear regulator circuit as in claim 1, wherein said first transistor is bipolar.

5. A linear regulator circuit as in claim 1, wherein said second transistor is a FET.

6. A linear regulator circuit as in claim 1, wherein said second transistor is bipolar.

* * * * *